United States Patent [19]

Clark et al.

[11] Patent Number: 4,540,171

[45] Date of Patent: Sep. 10, 1985

[54] VARIABLE RESISTANCE EXERCISE APPARATUS

[76] Inventors: Charles G. Clark, Apt. 614, 6621 Yale, Westland, Mich. 48185; Jack D. Clark, 3650 Hi-Dale Dr., Lake Orion, Mich. 48035

[21] Appl. No.: 389,023

[22] Filed: Jun. 16, 1982

[51] Int. Cl.[3] ..... A63B 21/06

[52] U.S. Cl. ..... 272/118; 272/123

[58] Field of Search ..... 272/118, 117, 123, 122, 272/134, DIG. 4, 93, DIG. 5, DIG. 6, DIG. 1

[56] References Cited

U.S. PATENT DOCUMENTS

| | | | |
|---|---|---|---|
| 857,447 | 6/1907 | Cooper | 272/118 |
| 3,235,255 | 2/1966 | Leflar | 272/123 |
| 3,346,256 | 10/1967 | White . | |
| 3,465,592 | 9/1969 | Perrine . | |
| 3,529,474 | 9/1970 | Olson et al. | 272/DIG. 4 |
| 3,572,700 | 3/1971 | Mastropaolo | 272/130 X |
| 3,784,194 | 1/1974 | Perrine | 272/DIG. 1 X |
| 3,848,467 | 11/1974 | Flavell | 272/DIG. 6 X |
| 3,858,873 | 1/1975 | Jones . | |
| 3,998,100 | 12/1976 | Pizatella et al. . | |
| 4,253,662 | 3/1981 | Podolak | 272/123 |

*Primary Examiner*—Richard J. Apley
*Assistant Examiner*—William R. Browne
*Attorney, Agent, or Firm*—Burton, Parker & Schramm

[57] ABSTRACT

An apparatus for muscular exercise where the user conducts a repetitive motion under load. The apparatus is coupled to the user to exercise the desired muscle group. When muscle is undergoing a shortening motion it is subjected to a load. At the completion of the shortening motion the load is automatically increased for the muscle-lengthening step. At the completion of the muscle-lengthening portion of the exercise the added load is automatically removed for the next muscle contraction step.

12 Claims, 7 Drawing Figures

32
3
16
18
48
50
34B
34A
24
26
2
2
36A
36B
3
30
10
12
38A
38B
22
44
46
20
40
42
28
-14-

66
68
70
66
68
70
74
74
74
72
72

VARIABLE RESISTANCE EXERCISE APPARATUS

DESCRIPTION

Field of Invention

This invention relates generally to the field of muscular exercise equipment and methods and more particularly to weight lifting exercise devices.

BACKGROUND OF THE INVENTION

A number of devices are commercially available which a user conducts a resistance exercise by lifting weights. The weights can be connected to a bar and freely lifted by the user or housed in a frame and coupled to the user in a great number of fashions in order to exercise a desired muscle. Movement of the weights is determined by the input force exerted by the user. Examples of this type of exercise device is shown in U.S. Pat. No. 3,235,255, Laflar, and U.S. Pat. No. 3,346,256, White.

The White and the Laflar devices use weights to exert a load on the user during the exercise motion. The force exerted by the user is a function of mass of the weight and the rate of acceleration. The maximum weight capable of being lifted by the user is determined by the portion of the exercise movement where the user is the weakest; this is typically the muscle shortening or positive movement. During any bodily movement some muscles will be contracting while others will be extending. In an exercise movement, the muscles or muscle group, which are doing the majority of the work is typically called the prime mover. When the prime mover muscles are being shortened, it is typically referred to as a positive exercise movement. When the prime mover muscles are lengthening this is typically referred to as a negative movement. In the muscle lengthening, or negative interval of the exercise movement, when the user is capable of carrying more weight, the White and Laflar devices make no provisions to fully exercise this unused muscular capacity.

Realizing that the muscle is not equally powerful throughout its entire range, and that the resistive force should vary as a function of the output force capable of the user, the device shown in U.S. Pat. No. 3,998,100, Pizatella et al, was developed. The object of the Pizatella invention is to exert a force on the user during a repetitive exercise motion. If the user is unable to maintain the predetermined rate of speed, the opposed resistive force is automatically decreased, so that the user has sufficient strength to keep pace with the programmed exercise speed. In this manner the device can fully tax the muscular potential of the user at all positions during the movement. The device emits a disciplinary conditioning signal to encourage the user to maintain the load and speed programmed for the exercise. The load is exerted upon the user by hydraulic cylinders, the pressure in which is controlled to achieve the desired load.

Another type device in which a user may utilize the full muscular potential at all positions during an exercise motion is the isokinetic apparatus which is shown in U.S. Pat. No. 3,465,592, Perrine. While the user goes through an exercise movement of a predetermined range and speed, he may exert his maximum force upon the apparatus and the movement will not exceed the predetermined rate. On the other hand, the user can exert the minimal effort upon the device and similarly maintain the predetermined rate of movement.

SUMMARY OF THE INVENTION

The object of the present invention is to apply different level loads on the user during a repetitive exercise dependent upon the user's strength at the particular period in the exercise cycle. The apparatus is comprised of a frame, a coupling means which connects the user to the apparatus which is designed to exercise a particular muscle group, a loading means which exerts a force on the user during the exercise, an unloading means which reduces the force exerted on the user during a portion of the exercise cycle, and a sensing means which controls the unloading and the reapplication of the portion of the load that is removed during a portion of the exercise cycle. With the user coupled to the apparatus a muscle shortening or positive motion is initially conducted. Then, automatically a load is applied for the muscle lengthening or negative portion of the exercise. The load is automatically removed at the completion of the muscle lengthening cycle so that the load exerted on the user during the muscle shortening, or positive movement is less than the load during the muscle lengthening or negative movement period. With this device, the muscle shortening or positive motion load can be set to any level desired, and an additional load automatically added during the muscle lengthening or negative motion when the user is capable of handling the load.

By allowing the user to support the weight and move at his own rate, balance and coordination is developed during the exercise in addition to muscle strengthening. The force exerted on the user is a function of the mass he is lifting and the rate of acceleration. When the user is stronger during the initial repetitions, he may accelerate at higher rates to fully utilize his strength potential. As fatigue developes, the user can reduce the acceleration rate until the point where the exercise can no longer be continued.

By allowing the load during the negative or muscle lengthening portion of the exercise to be greater than the positive or muscle shortening motion, more rapid strength gains are achievable. The advantages of exercising while the muscles are loaded during a negative motion are documented in the literature search conducted by J. Atha published in *Exercise & Sports Sciences Reviews,* chapter entitled "Strengthening Muscles" by American College of Sports Medicines, February 1982.

One configuration of this invention is a "power-rack" type device in which the user lifts a barbell with weights on each end. The barbell is located within the confines of the frame of the exercise apparatus. The barbell has limited free travel in both the vertical and horizontal direction. The freedom of horizontal movement is tended to stregthened the users bracing muscles which will diminish chances of injury while performing other atheletic skills such as running or jumping which requires strong bracing or supplemental muscles in addition to a strong prime mover muscle group. As the user lifts the bar to a preset vertical height, additional weight is added to the bar for the negative or lowering portion of the exercise. When the user lowers the bar to a specified level, the weight which was added is removed and lifted into position so it can be added for the next cycle. These auxiliary weights which are added for the negative portion of the exercise can be raised by several mechanical systems which include cable, gear or screw type apparatuses.

The basic weight which is installed on the bar can be set to sufficiently tax the user during the positive portion of the exercise, and the auxiliary weights installed so that the user is sufficiently taxed during the negative portion of the exercise. Limit switches which detect the movement of the bar and can be positioned so that the auxiliary weight may be installed and removed at any position in the exercise desired. The auxiliary weight may be added before or after the user reaches maximum vertical position and removed before or after reaching the minimum vertical position. This flexibility allows this invention to be adapted for various users and exercises.

This "power-rack" type configuration of the invention is intended to allow limited free horizontal movement of the bar. The user must control both the horizontal and vertical movement of the bar during the exercise and thereby develop balance and coordination. When the auxiliary load is installed it is coupled to the user in such a manner as to allow substantially free horizontal movement of the bar.

An alternative configuration of this invention has weights located in a frame and linked to the user by a coupling means such as lever, pulley, and cable arrangement. Any number of exercises can be developed where a movement of the user causes the weights to move vertically within the frame. The weights may be loose plates which are added to achieve the desired load, or the commonly used stack arrangement with a selector pin. By positioning the pin, any number of the weights may be coupled to the user, so that the weight can be varied in discrete increments.

The apparatus of this present invention generally is comprised of a frame, a coupling means, a loading means, an unloading means, and a sensing means. The coupling means can be a barbell in a "power-rack" type device, or a cable-pulley-lever arrangement as used in the selector weight stack configuration. The coupling means connects the user to a loading means which is preferably a series of weights, although liquid filled containers, pressurized cylinders, springs, or elastic members could be used as a loading means to exert a load on the user. An unloading means is used to reduce the load exerted on the user during a portion of the exercise. The unloading means is preferably a mechanism which lifts some of the weights in a fashion so that they are not coupled to the user. When the user reaches a specified point in the exercise, sensing means, such as a photoelectric cell or an electro-mechanical switch, cause the unloading means to reapply the load so it is again coupled to the user. The sensing means can be positioned freely so that the point in the exercise when a portion of the load is removed and subsequently reapplied can be varied to suit the needs of individual users and various exercise motions.

BRIEF DESCRIPTION OF THE PREFERRED EMBODIMENT

Figure 1:
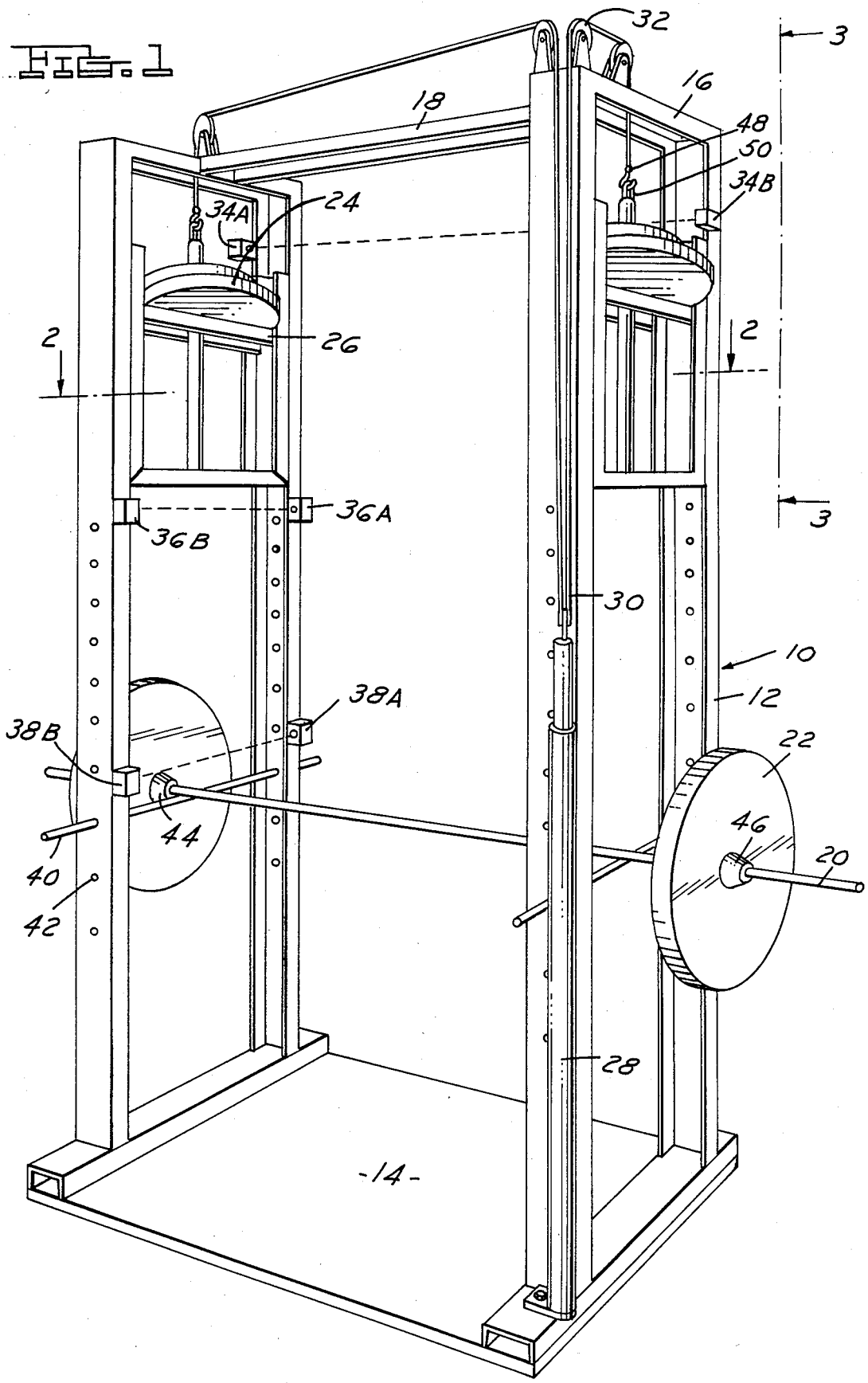
FIG. 1 is a diagram of the "power-rack" type embodiment of this invention, where a hydraulic cylinder cable and pulley arrangement is used to lift the auxiliary weights.
Figure 2:
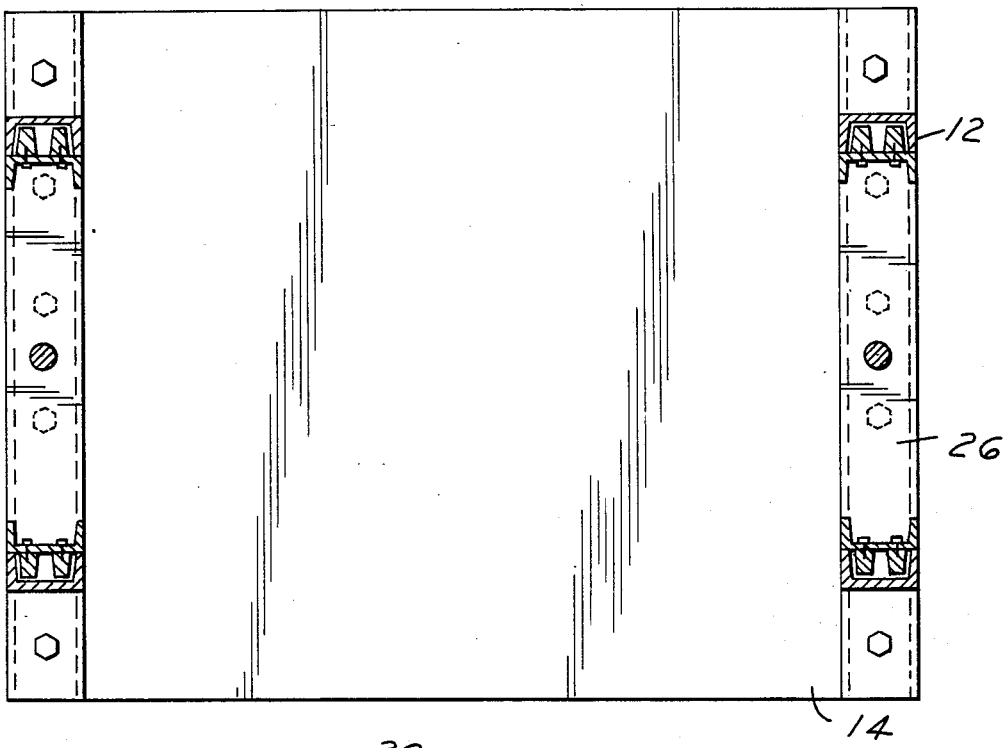
FIG. 2 is a top view taken on line 2—2 in FIG. 1, showing the attachment of the subframe to the frame of the apparatus.
Figure 3:
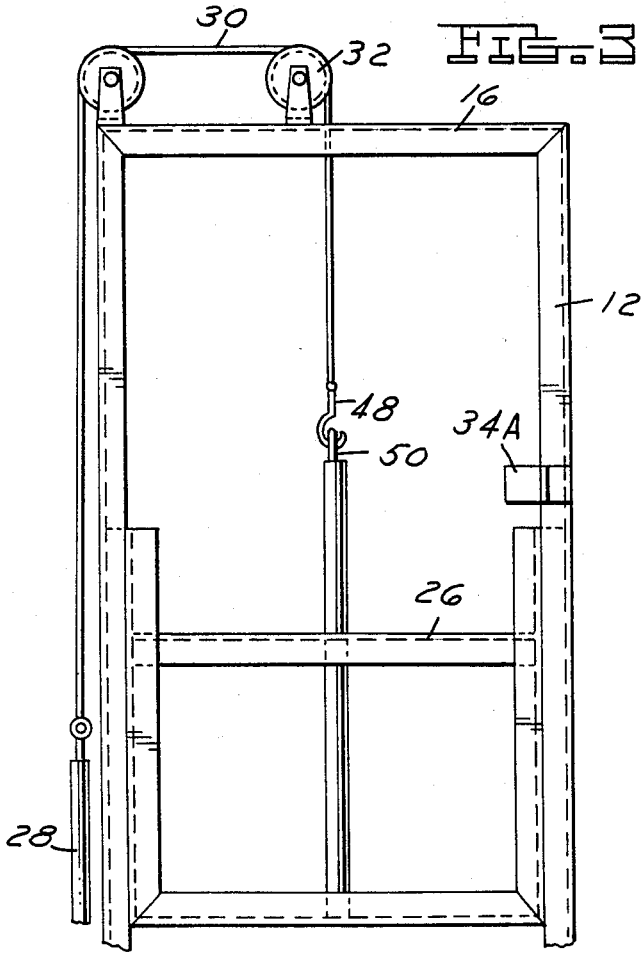
FIG. 3 is a side elevation taken on line 3—3 of FIG. 1 showing a cable and pulley arrangement attached to the sub-frame for the auxiliary weight.

Referring to FIG. 1 of the drawings, the variable resistance exercise apparatus comprises five main components: a frame, coupling means, loading means, unloading means, and a sensing means. In the configuration of the invention shown in FIG. 1, the frame 10 is formed by four rails 12 which extend vertically from base 14, joined at the top by side brace 16 and cross brace 18. The coupling means which connects the user to the apparatus is bar 20. The user lifts bar 20 and moves it within the confines of the frame 10 during a repetitive exercise motion. The loading means in the FIG. 1 apparatus consists of basic weight plates 22 which are attached to the ends of bar 20. The basic weights are supported by the user throughout the exercise. Auxiliary weights 24 are located in auxiliary weight subframes 26. The subframes move vertically within frame rails 12 and rest upon bar 20 during a portion of the exercise motion.

The unloading means in the apparatus shown in FIG. 1 is a hydraulic cylinder 28 which is fastened to the frame 10 and cables 30. When the cylinder is pressurized in a manner causing it to contract, cable 30 which is routed along pulleys 32 lifts the auxiliary weight subframes 26. When the hydraulic fluid is allowed to escape from the cylinder, auxiliary weights 24 cause the subframes 26 to move downwardly until they engage bar 20, causing the auxiliary weight 24 to be borne by the user.

The timing of the unloading and reapplication of the auxiliary load is controlled by sensing means such as a photo-sensitive switch or an electro-mechanical switch. A configuration in FIG. 1 uses three photo switches as a sensing means: top limit switches 34A and 34B, release limit switches 36A and 36B, and bottom limit switches 38A and 38B. These switches can be moved along the frame rails 12 so that the auxiliary load is removed and reapplied at any desired position in the exercise motion. This flexibility allows the apparatus to be used for an unlimited number of exercise motions and accommodate users of varying strengths.

Top limit switches 34A and 34B and bottom limit switches 38A and 38B sense the motion of the auxiliary load in the frame. Release limit switch 36A and 36B sense the motion of bar 20 at the end of the muscle contraction or positive portion of the exercise, when the auxiliary weight subframes 26 are in the upper position in the frame rails 12 as shown in FIG. 1. When the bar 20 reaches the level of the release limit switches 36A and 36B, the auxiliary weight subframes 26 are lowered to contact and be supported by bar 20. When the auxiliary weight subframes 26 are lowered to the level of the bottom limit switches 38A and 38B the unloading means, in this instance, the hydraulic cylinder 28 is activated to raise the auxiliary weight subframes 26. The subframes are lifted until the reach top limit switch 34A and 34B. The auxiliary weight subframes 26 are held at this upper level until bar 20 is raised to engage release limit switches 36A and 36B at which time the auxiliary weight subframes 26 are lowered to contact a bar for another muscle extension or negative cycle.

An example of a typical exercise which would be conducted with this apparatus is a squat. Bar 20 will be placed slightly below the user's shoulder level on catches or stands (not shown). A total basic weight is chosen which the user is capable of lifting in the positive direction for a number of repetitions. Basic weights 22, which equal half of the total desired basic weight, are installed on the ends of bar 20 and retained between inside collars 44 and outside collars 46. To install the desired auxiliary load, a hydraulic cylinder 28 is depressurized, allowing the auxiliary weight subframes 26 to move downward until contacting bar 20. Cable 30 can then be detached from the subframe 26 by separating hook 48 attached to the end of cable 30 from loop 50 which is attached to auxiliary weight subframe 20. With the cable 30 detached from auxiliary weight subframe 26, the auxiliary weights 24 may be added, with half of the weights to be installed on each auxiliary weight subframe 26. The cable 30 is then reattached to auxiliary weight subframe 26 by connecting hook 48 to loop 50. An auxiliary weight 24 is chosen which the user is capable of supporting during the negative or lowering portion of the exercise.

Prior to starting the exercise, the hydraulic cylinder 28 is pressurized so that the auxiliary weight subframes 26 are moved to their upper position. Bar 20 is placed on stands (not shown) slightly below the user's shoulder level. The user then positions himself below the bar 20 so that it rests on his shoulders. The user then lifts the bar 20 and the basic weights 22, using his leg muscles. At a predetermined point near the top of the lift the bar will break the light beam of the release limit switch 36A and 36B. At this point the pressure in the hydraulic cylinder 28 will be reduced so that the auxiliary weight subframes 26 will lower into position to contact bar 20. With the user now supporting the weight of the basic weight 22 and the auxiliary weights 24, the exercise motion is continued until the subframes 26 are lowered to the level of the bottom limit switch 38A and 38B. At this time the auxiliary weights 24 are removed by pressurizing the hydraulic cylinder 28, causing auxiliary weight subframes 26 to be lifted so that they no longer contact bar 20. This sequence is repeated as the user conducts repetitive lifting and lowering motions during the squat.

Figure 4:
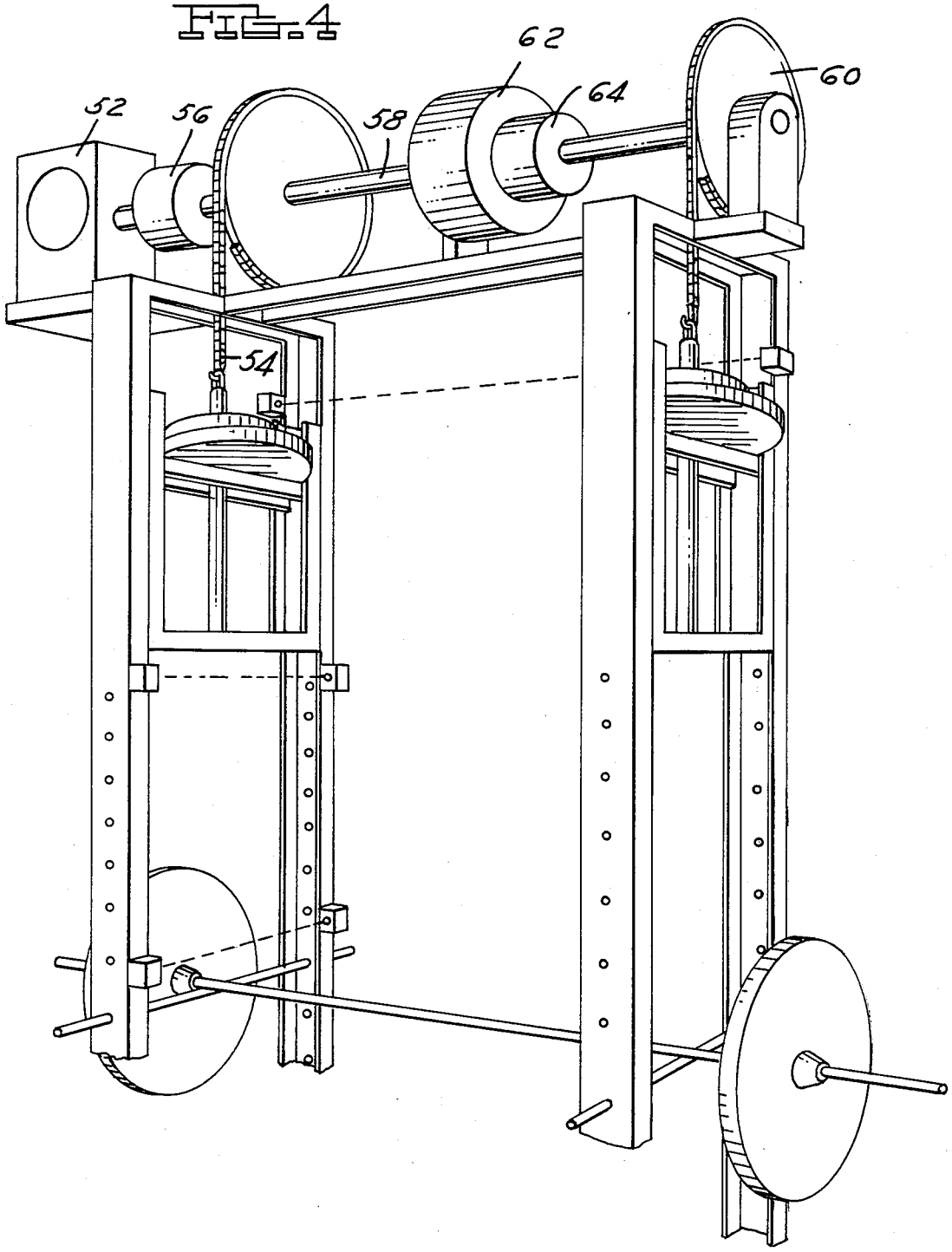
FIG. 4 shows a "power-rack" type configuration of the apparatus where an electric motor with chain and sprocket arrangement is used as an unloading means to position the auxiliary weights.

FIG. 4 shows a "power-rack" type device similar to that in FIG. 1. However, rather than using a hydraulic unloading means, the FIG. 4 configuration uses an electric motor 52 which is coupled to the auxiliary weight subframes 26 by chains 54. Electric motor 52 has an internal gear box to provide the necessary output (RPM) and mechanical advantage to raise the auxiliary weight subframes 26 when fully loaded. For example, the drive speed may be set so as to raise the subframe 26 at a velocity faster than the velocity the user will be raising bar 20 during the muscle shortening or positive portion of the exercise. The output of the electric motor 62 is connected to a clutch 56. The output of the clutch is connected to shaft 58. Sprockets 60 are affixed to shaft 58. The diameter of sprockets 60 is such that the circumference exceeds the maximum travel of the auxiliary weight subframe 26. Chain 54 is removably attached at one end to auxiliary weight subframe 26 and affixed to sprocket 60 on its other end as shown. As shaft 58 is rotated, auxiliary weight subframes 26 move vertically within frame rails 12. A spring engaged electric release brake 62 and one-way clutch 64 are attached to shaft 58 and affixed to frame cross brace 18. One-way clutch 64 allows the electric motor 52 to freely rotate when raising auxiliary weight subframes 26. Brake 62 prevents the weights from falling when the motor 52 is deactivated. When it is time to lower the auxiliary weight subframes 26 into contacting relation to bar 20, clutch 56 is disengaged and brake 62 released, allowing auxiliary weight subframes 26 to be supported by bar 20 for the downward or negative portion of the exercise movement. Brake 62 is a spring engaged electric release type, so in event of an electrical failure the auxiliary weight subframes 26 will not fall upon the user.

Figure 5:
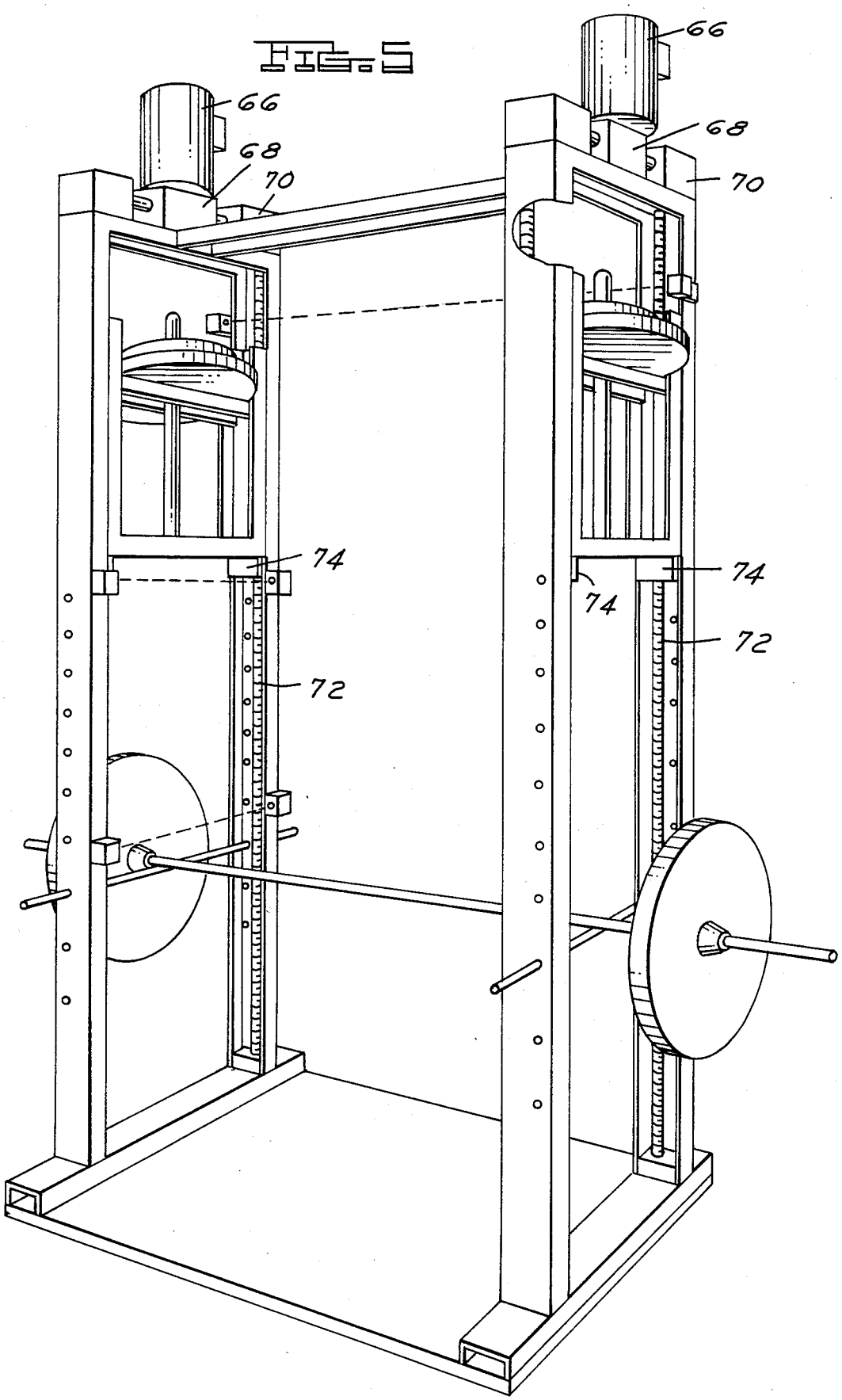
FIG. 5 is a "power-rack" type configuration of the invention where the unloading means is an electric motor which drives screws which lift the subframes carrying the auxiliary load.

FIG. 5 shows a "power-rack" type device similar to that in FIGS. 1 and 4. However, rather than using tensilely loaded members to lift the auxiliary weight subframes 26, the FIG. 5 configuration uses an electric motor driven screw to support the subframes 26 from below. Two electric motors 66 are located atop the apparatus on cross brace 18. The motor 60 is connected to a gear box 68 which has two right angle outputs. Each output of the speed reducer 68 is connected to right angle gear boxes 70 which drive a recirculating ball screw 72. As the screw 72 rotates, nut 74 moves linearly along the frame rail 12, which prevents the nut 74 from rotating as the screw 72 turns. The bottom edge of auxiliary weight subframes 26 rests upon the four nuts 74. As the screws 72 are rotated, the nuts 74 move linearly along the frame rails 12, causing the auxiliary weight subframe 26 to be lifted and lowered. The auxiliary weight subframe 26 is free to be lifted off the nuts 74 which merely form a lower travel stop. The auxiliary weight subframe 26 and auxiliary weights 24 may be positioned as desired by rotating motor 66 either clockwise or counterclockwise. Since auxiliary weight subframes 26 are supported on the outside edge, auxiliary weight 24 can be added and removed without disconnecting a cable as required in the device in FIG. 1. The operation of the FIG. 5 apparatus is otherwise similar to the "power-rack" type device shown in FIG. 1, employing a hydraulic cylinder unloading means.

Figure 6:
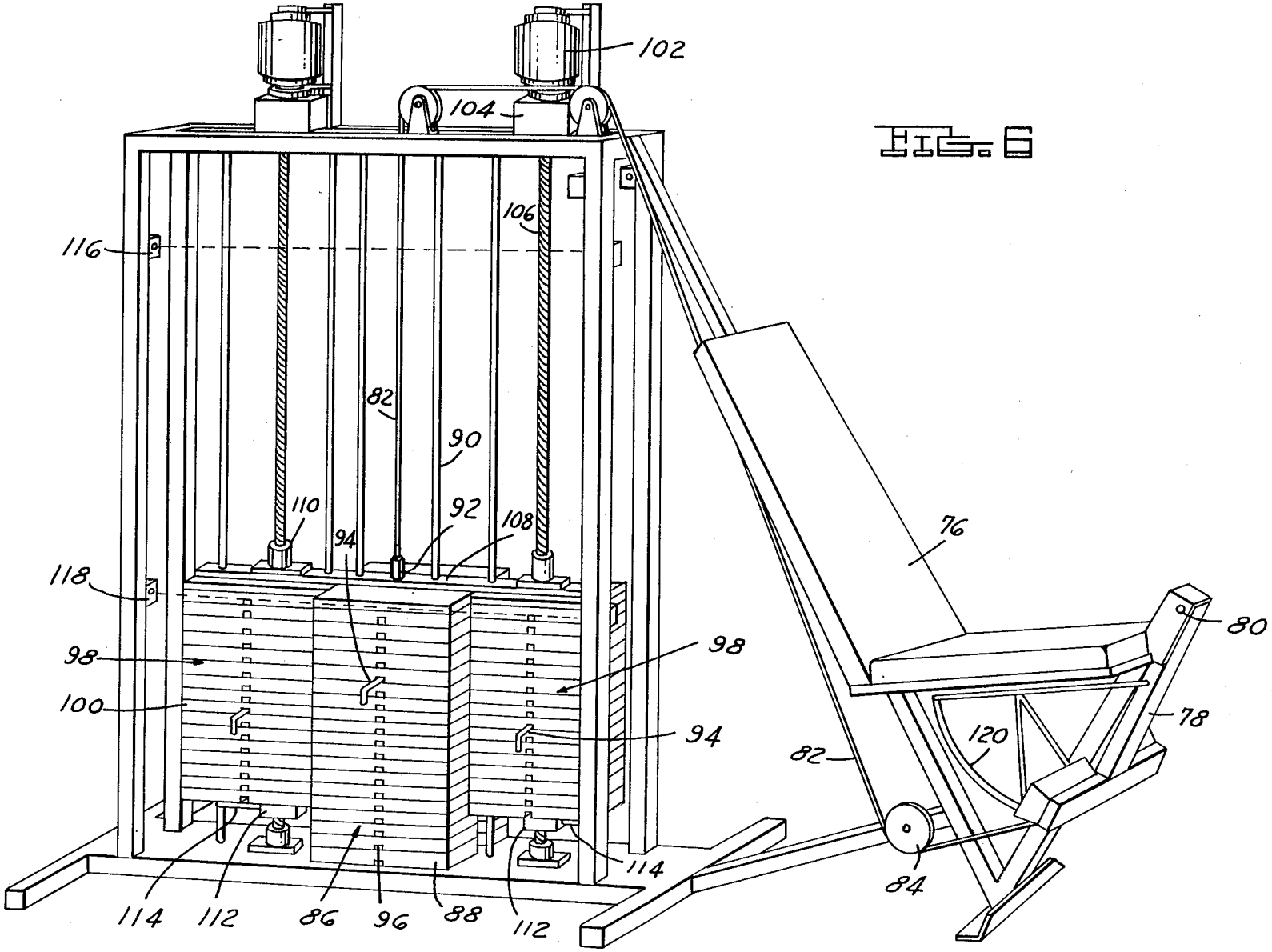
FIG. 6 shows a configuration of the invention using a weight selector stack as a loading means and a cable-pulley-coupling means designed to exercise the user's thigh muscle. The unloading means is an electric motor screw arrangement.

FIG. 6 shows a leg extension configuration of the invention which uses a weight stack loading means. The user sits in chair 76, placing his legs behind T-bar 78. T-bar 78 is pivotably attached to chair 76 by hinge 80. As the user extends his legs contracting his thigh muscle, T-bar 78 rotates, causing cable 82 to be loaded in tension. Cable 82 is affixed at one end to T-bar 78, routed around pulleys 84 and affixed to basic weight stack 86. Basic weight stack 86 is comprised of a series of plates 88 stacked vertically upon one another. Guide bars 90 extend through plates 88, allowing them to move only along the vertical axis. Selector bar 92 is affixed to one end of cable 82 and extends through the weights in the stack 86. Selector bar 92 has a series of holes designed to accept selector bar pin 94. Selector bar pin 94 is inserted into the selector bar 92 through grooves 96 in the weight plates 88. When cable 82 raises the selector bar 92, with all those weight plates 88 located above the pin 94 will be lifted while those weight plates 88 below pin 94 will remain stationary. This weight stack arrangement allows the load lifted by the user to be varied in increments of the weight stack plates.

The auxiliary load in the apparatus shown in FIG. 6 is provided by auxiliary weight stacks 98. Guide bars 90 extend through the weight plates 100 and auxiliary weight stack 98. The auxiliary weight is raised into position by electric motor 102 whose output is connected to gear box 104 which in turn drives screws 106. Auxiliary weight loading bar 108 rests upon the basic weight stack 86 as shown in FIG. 6. Tube 110 surrounds screw 106 and is affixed to loading bar 108. Loading bar 108 may be moved freely in a vertical direction along guide bars 90 and screws 106. Pins 94 may be inserted into the auxiliary weight stacks 98, engaging tube 110, causing the weight plates 100 located above pins 94 to be raised when loading bar 108 and tubes 110 are lifted. In the lowered position, tubes 110 rest on nuts 112. Nut 112 has an attached arm 114 which engages guide bar 90 so as to prevent it from rotating. When screws 106 are rotated, nut 112 moves vertically, lifting tubes 110 and all weight plates 100 located above pin 94 in weight stack 98.

At the start of the exercise, loading bar 108 and the desired auxiliary weight are raised to the desired auxiliary load application point. When the user extends his legs, it causes T-bar 78 to pull cable 82, resulting in the lifting of the basic weight stack above pin 94. When basic weight stack reaches release limit switch 116, the electric motors 102 turn the screw in the direction causing the auxiliary weight stacks to be lowered. When the auxiliary load bar 108 contacts the basic weight, the auxiliary load becomes coupled to the user and the nuts 112 continue to proceed down the screw 106. When the user lowers the weight to the bottom limit switch 118, motor 102 turns screw 106 in the direction to cause nut 112 to raise the auxiliary weights for another repetition.

T-bar 78 is equipped with a cam 120 which engages cable 82 as T-bar 78 is rotated on hinge 80. Cam 120 allows the mechanical advantage of the user to vary with the location of the T-bar 78, so that any desired load function may be developed to optimally exercise the user's muscle.

Figure 7:
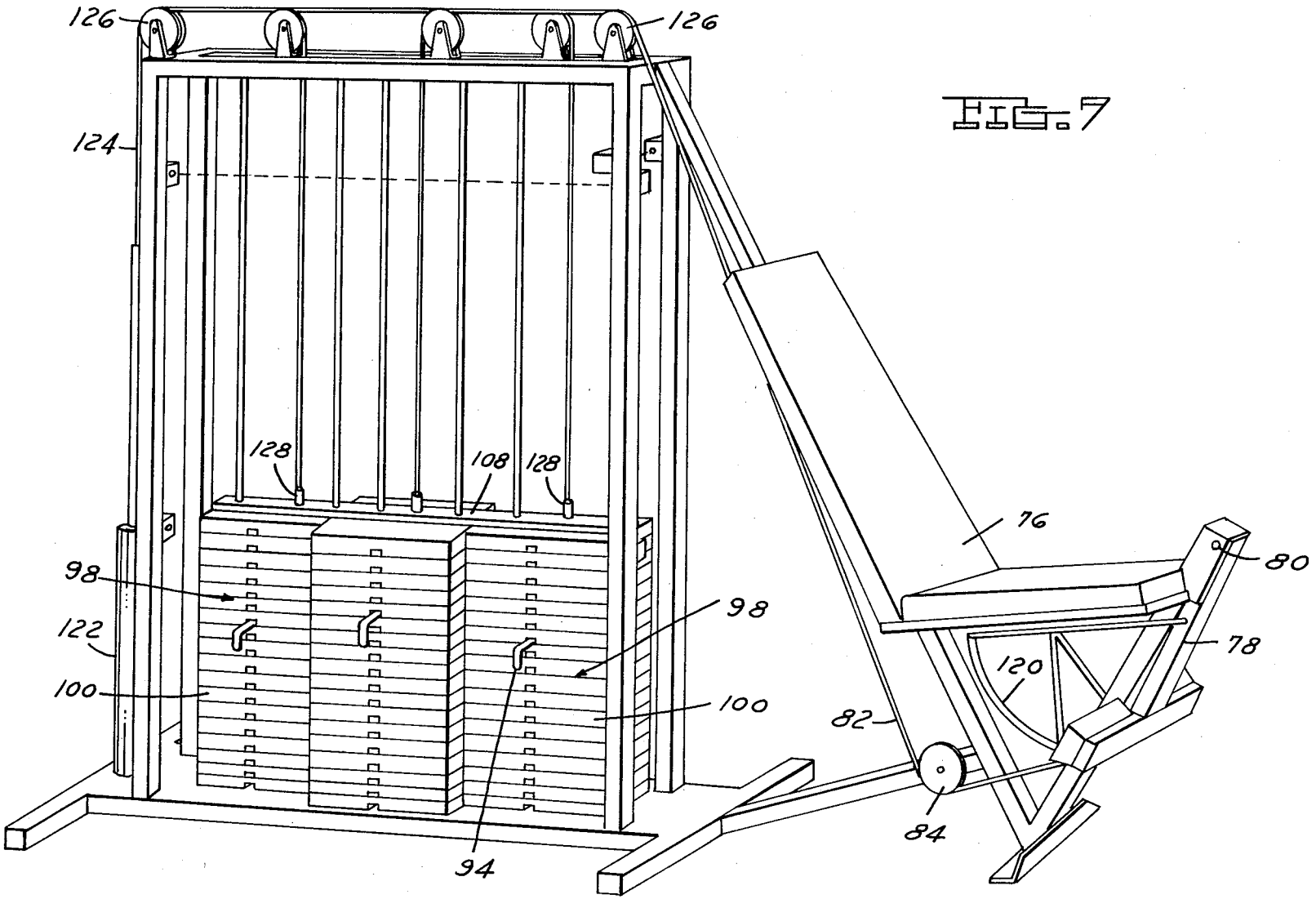
FIG. 7 is similar to FIG. 6, however the unloading means is a hydraulic cylinder which is attached to the auxiliary load by means of a cable and pulley.

FIG. 7 shows an apparatus similar to FIG. 6. However, the unloading means is a hydraulic cylinder rather than a ball and screw arrangement. Hydraulic cylinder 122 is connected to cable 124 and connected to auxiliary weight loading bar 108 by pulleys 126. Rather than tubes 110 which rest on nuts 112 used in FIG. 6, the FIG. 7 apparatus employs a selector bar 128 which extends into the auxiliary weight stacks 98. Selector bars 128 are affixed to the auxiliary loading bar 108, so when cables 124 raise loading bar 108, all of the auxiliary weight plates 100 above pin 94 are also raised. Other than the differences in the unloading means, the FIG. 7 apparatus operates in the same fashion as does the apparatus in FIG. 6.

The weight stack type apparatus shown in FIGS. 6 and 7 can be adapted using the various coupling means to provide a wide variety of exercises. Common to all exercises with this apparatus is the fact that a positive or muscle shortening motion takes place, then automatically a load is applied to the user for the negative or muscle lengthening motion. Near the completion of the negative motion the load is automatically removed for the next positive motion. The user is free to move during both the positive and negative motions at his own rate, which will be dependent upon the load, his strength, and fatigue. A load may be coupled to the user in a manner to exercise any desired muscle. By having a load during the negative motion which is greater than the load during the positive motion, it is believed that more rapid gains in muscle strength are achievable than using the constant load, progressive resistance, or isometric exercise method. By allowing the user to move at his desired rate, the user may move rapidly during the initial repetition and more slowly as fatigue reduces his strength.

We claim:

1. An apparatus for physical exercise where a user conducts a repetitive cyclic movement while subjected to a load which is reduced in magnitude during parts of each cycle wherein the muscles of the user go through a lengthening and shortening, said apparatus comprising:

(a) a frame;

(b) a coupling means which cooperates with the frame for coupling the user to the apparatus;

(c) a loading means which cooperates with the coupling means to exert a force on the user during the exercise which constitutes a lengthening of the muscles;

(d) an unloading means which cooperates with the frame and the loading means to reduce the force exerted on the user during a portion of the exercise which constitutes a shortening of the muscles; and (e) means for sensing the position of the coupling means to signal the unloading means to remove a portion of the load during a portion of the exercise cycle when the muscles are being shortened and to signal the loading means to reapply a portion of the load during a portion of the exercise cycle when the muscles are being lengthened.

2. The apparatus of claim 1 wherein said loading means is comprised of a basis loading means which cooperates with the coupling means, and an auxiliary loading means which intermittently cooperates with the coupling means, said auxiliary loading means cooperating with the unloading means.

3. The apparatus of claim 2 wherein both the basic and auxiliary loading means each comprise one or more weights and which cooperate with the coupling means during a portion of the exercise cycle and move in response to the user's exercise motion, with at least a component of the motion of the weights being vertical.

4. The apparatus of claim 3 wherein the auxiliary loading weights can be moved independently of the basic loading weights so the auxiliary loading weights may be placed in cooperating relation with the coupling means during part of the exercise cycle and moved into a non-cooperating relation during another part of the exercise cycle.

5. The apparatus of claim 4 wherein said unloading means acts upon the auxiliary loading weights to cause the auxiliary weight to move into cooperating relation with the coupling means for a portion of the exercise cycle and be subsequently removed from such cooperating relation.

6. The apparatus of claim 5 wherein said sensing means monitors the movement of the user, by sensing the movement of the basic loading weights, and supplies a control signal causing the unloading means to remove and reapply the auxiliary loading weights.

7. An apparatus for physically exercising muscles by applying a load on a user during a repetitive motion, said load being one magnitude when the exercised muscle is lengthening and a reduced magnitude for part of the exercise when the muscle is shortening said apparatus comprising:

(a) a frame;

(b) a coupling means which cooperates with the frame for coupling the user to the apparatus to exercise the desired muscle group;

(c) a loading means which cooperates with coupling means to exert a force on the user during the exercise which constitutes the lengthening of the muscles;

(d) an unloading means which cooperates with the frame and the loading means to reduce the force exerted on the user during a portion of the exercise which constitutes a shortening of the muscles; and (e) means for automatically sensing the position of the coupling means to signal the unloading means to remove a portion of the load during that portion of the exercise cycle when the muscles are being shortened and to signal the loading means to reapply automatically a portion of the load during a portion of the exercise cycle when the muscles are being lengthened.

8. The apparatus of claim 7 wherein said loading means is comprised of a basic loading means which cooperates with the coupling means, and an auxiliary loading means which intermittently cooperates with the coupling means.

9. The apparatus of claim 8 wherein both the basic and auxiliary loading means each comprise one or more weights and which cooperate with the coupling means during a portion of the exercise cycle and move in response to the user's exercise motion, with at least a component of the motion of the weights being vertical.

10. The apparatus of claim 9 wherein the auxiliary loading weights can be moved independently of the basic loading weights so the auxiliary loading weights may be placed in cooperating relation with the coupling means during part of the exercise cycle and moved into a non-cooperating relation during another part of the exercise cycle.

11. The apparatus of claim 10 wherein said unloading means acts upon the auxiliary loading weights to cause the auxiliary weight to move into cooperating relation with the coupling means for a portion of the exercise cycle and be subsequently removed from such cooperating relation.

12. The apparatus of claim 11 wherein said sensing means monitors the movement of the user, by sensing the movement of the basic loading weights, and supplies a control signal causing the unloading means to remove and reapply the auxiliary loading weights.

* * * * *